US007125634B2

(12) United States Patent
Tong et al.

(10) Patent No.: US 7,125,634 B2
(45) Date of Patent: Oct. 24, 2006

(54) REVERSIBLY COLOR CHANGING UNDERCOAT LAYER FOR ELECTROPHOTOGRAPHIC PHOTORECEPTORS

(75) Inventors: Yuhua Tong, Webster, NY (US); John F. Yanus, Webster, NY (US); Jin Wu, Webster, NY (US); John J. Wilbert, Macedon, NY (US); Nancy L Belknap, Rochester, NY (US); Linda L. Ferrarese, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 256 days.

(21) Appl. No.: 10/800,943

(22) Filed: Mar. 15, 2004

(65) Prior Publication Data

US 2005/0202330 A1 Sep. 15, 2005

(51) Int. Cl.
*G03G 5/147* (2006.01)

(52) U.S. Cl. ..... 430/60; 430/97

(58) Field of Classification Search ..... 430/60, 430/97

See application file for complete search history.

(56) References Cited

U.S. PATENT DOCUMENTS

| | | | | |
|---|---|---|---|---|
| 3,121,006 | A | 2/1964 | Middleton | |
| 4,233,384 | A | 11/1980 | Turner | |
| 4,265,990 | A | 5/1981 | Stolka | |
| 4,299,897 | A | 11/1981 | Stolka | |
| 4,306,008 | A | 12/1981 | Pai | |
| 4,439,507 | A | 3/1984 | Pan | |
| 4,587,189 | A | 5/1986 | Hor | |
| 4,618,552 | A | 10/1986 | Tanaka | |
| 5,051,328 | A | 9/1991 | Andrews | |
| 5,089,908 | A | 2/1992 | Jodoin | |
| 5,252,422 | A | 10/1993 | Okano et al. | 430/131 |
| 5,314,776 | A | 5/1994 | Nomura | |
| 5,443,934 | A | 8/1995 | Suzuki et al. | 430/64 |
| 5,460,911 | A * | 10/1995 | Yu et al. | 430/64 |
| 5,612,157 | A | 3/1997 | Yuh | |
| 5,641,599 | A * | 6/1997 | Markovics et al. | 430/58.25 |
| 5,789,127 | A | 8/1998 | Yamaguchi | |
| 6,361,913 | B1 | 3/2002 | Pai | |
| 6,479,202 | B1 | 11/2002 | Shida | |
| 2005/0058919 | A1 * | 3/2005 | Tong et al. | 430/64 |

FOREIGN PATENT DOCUMENTS

| | | |
|---|---|---|
| JP | 57049962 | 3/1982 |
| JP | 62264061 | 11/1987 |

OTHER PUBLICATIONS

European Search Report, Application No. EP 05 10 1912, dated Jun. 30, 2005, 3 pages.

* cited by examiner

*Primary Examiner*—John L Goodrow
(74) *Attorney, Agent, or Firm*—Marylou J. Lavoie, Esq. LLC

(57) ABSTRACT

An imaging member includes an electroconductive support containing an electroconductive layer thereon; thereover a first layer comprising a metal alkyloxide, an amino siloxane, and a color change material dispersed in a binder; wherein the color change material is a material that reversibly changes color in the presence of a Lewis base and which color change is reversible upon exposure to light; and a charge generating layer and a charge transport layer.

28 Claims, 3 Drawing Sheets

REVERSIBLY COLOR CHANGING UNDERCOAT LAYER FOR ELECTROPHOTOGRAPHIC PHOTORECEPTORS

TECHNICAL FIELD

The present invention relates to electrophotographic imaging members and more particularly relates to layered electrophotographic photoreceptor members having a reversibly color changing undercoat layer.

BACKGROUND OF THE INVENTION

Electrophotographic imaging members, i.e., photoreceptors, typically include a photoconductive layer formed on an electrically conductive substrate. The photoconductive layer is an insulator in the dark so that electric charges are retained on its surface. Upon exposure to light, the charge is dissipated.

A latent image is formed on the photoreceptor by first uniformly depositing electric charges over the surface of the photoconductive layer by one of any suitable means known in the art. The photoconductive layer functions as a charge storage capacitor with charge on its free surface and an equal charge of opposite polarity (the counter charge) on the conductive substrate. A light image is then projected onto the photoconductive layer. On those portions of the photoconductive layer that are exposed to light, the electric charge is conducted through the layer reducing the surface charge. The portions of the surface of the photoconductor not exposed to light retain their surface charge. The quantity of electric charge at any particular area of the photoconductive surface is inversely related to the illumination incident thereon, thus forming an electrostatic latent image.

The photo-induced discharge of the photoconductive layer requires that the layer photogenerate conductive charge and transport this charge through the layer thereby neutralizing the charge on the surface. Two types of photoreceptor structures have been employed: multilayer structures wherein separate layers perform the functions of charge generation and charge transport, respectively, and single layer structures in which photoconductors perform both functions. These layers are formed on an electrically conductive substrate and may include an optional charge blocking layer and an adhesive layer between the conductive substrate and the photoconductive layer or layers. Additionally, the substrate may comprise a non-conducting mechanical support with a conductive surface. Other layers for providing special functions such as incoherent reflection of laser light, dot patterns for pictorial imaging, or subbing layers to provide chemical sealing and/or a smooth coating surface may also be employed.

One common type of photoreceptor is a multi-layered photoreceptor having a structure comprising an electrically conductive substrate, an undercoat layer formed on the substrate, a charge generating layer applied on the undercoat layer, and a charge transport layer formed on the charge generating layer. The phrases "charge blocking layer" and "blocking layer" are generally used interchangeably with the phrase "undercoat layer." U.S. Pat. No. 5,314,776 to Nomura, Fukuda, Nagasaki, and Suda entitled "Multi-layered Photoreceptor for Electrophotography" describes a process for manufacturing a photoreceptor comprising a substrate which comprises an electroconductive support or a support having an electroconductive film formed thereon; an undercoat layer including a material selected from the group consisting of silicon dioxide and other silicon oxides formed on the substrate; a carrier generation layer formed on the undercoat layer; and a carrier transport layer formed on the charge generation layer.

U.S. Pat. No. 6,479,202 to Shida, Uchino, and Itami entitled "Electrophotographic Photoreceptor, Electrophotographic Image Forming Method, Electrophotograhic Image Forming Apparatus and Processing Cartridge" describes an electrophotographic photoreceptor having on a support a resin layer comprising a siloxane resin formed by hardening a compound represented by Formula 1, 2 or 3, or a hydrolyzed product which has a structural unit having a charge transportation ability, wherein a ratio M1/M2 of the sum of the amount of moles M1 of the compound represented by Formula 1 and that represented by Formula 2 to the amount in moles of the compound represented by Formula 3 is within the range of from 0.01 to 1;

$$Si(OR_{1'})_4 \qquad \text{Formula 1}$$

$$R_1Si(OR_{2'})_3 \qquad \text{Formula 2}$$

$$R_1R_2Si(OR_{3'})_2 \qquad \text{Formula 3}$$

wherein the formulas $R_1$ and $R_2$ each represent an alkyl group having one to ten carbon atoms, a phenyl group, an aryl group, a vinyl group, an amino group, a γ-glycidoxypropyl group, a γ-methacryloxypropyl group, or a $C_nF_{2n+1}C_2H_4$— group, $R_{1'}$, $R_{2'}$, and $R_{3'}$ each representing an alkyl group and the groups represented by $R_{1'}$, $R_{2'}$, and $R_{3'}$ may be the same or different from each other.

U.S. Pat. No. 6,361,913 to Pai and Yanus entitled "Long Life Photoreceptor" describes an electrophotographic imaging member comprising a substrate, a charge generating layer, a charge transport layer, and an overcoat layer comprising a hydroxytriphenyl methane having at least one hydroxy functional group and a polyamide film forming binder capable of forming hydrogen bonds with the hydroxy functional group of the hydroxy triphenyl methane molecule, the charge transport layer being substantially free of triphenyl methane molecules.

An undercoat layer may be provided to cover up substrate defects, to improve print quality (such as to reduce or eliminate imagewise constructive interference effects known as "plywood effect"), to ensure environmental insensitivity, and/or to enable good electrical properties, e.g., block holes, transport electrons, enable cyclic stability, provide low surface potential residue of photo-induced discharge (Vr) and dark decay (Vdd), and improve coating uniformity.

For electrophotographic imaging systems which utilize uniform negative polarity charging prior to imagewise exposure, it is important that the undercoat charge blocking layer bleeds off negative charge while preventing positive charge leakage. In this case, the undercoat layer which is thick enough to cover up the roughened surface of the substrate is desired. Further, undercoat layers that are too thin are more susceptible to the formation of pinholes which allow both negative and positive charges to leak through the charge blocking and result in print defects. Also, when charge blocking undercoat layers are too thin, small amounts of contaminants can adversely affect the performance of the charge blocking undercoat layer and cause print defects due to passage of both negative and positive charges through the layer. Defects in the hole blocking layer, which allow both negative and positive charges to leak through, lead to the development of charge deficient spots associated with copy print-out defects.

Generally, undercoat layer formulations can be classified as dispersed undercoat layer solutions or homogeneous undercoat layer solutions. Dispersed undercoat layers comprise non-soluble particles in binders and solvents. Homogenous undercoat layers comprise charge conductive species soluble in binders and solvents. A known method for preparing dispersed undercoat layer solutions comprises mixing metal oxides with polymeric binders in an organic solvent. The metal oxides may comprise, for example, titanium oxide, zinc oxide, zirconium oxide, tin oxide and aluminum oxide, among others. A wide variety of polymeric resin binders have been employed for this purpose, such as, for example, polyimides, polyamides, polyacrylates, vinyl polymers and other specialty materials. The dispersion procedure is very time-consuming. In order to achieve good electrical properties, the metal oxide particles in the solution must be nanometer grade in size. Problematically, in the standing dispersed solution, the metal oxide tends to precipitate, causing macro-phase separation which results in non-uniform coatings.

The process for preparing homogeneous undercoat layers is generally more convenient than that for preparing dispersed undercoat layers. Generally, the process for preparing homogeneous undercoat layers comprises mixing the forgoing materials in the suitable solvents and applying the mixture to an electrically conductive substrate using suitable coating methods as known in the art. As an example, a three-component undercoat layer is described in U.S. Pat. No. 5,789,127 to Yamaguchi and Sakaguchi entitled "Electrophotographic Photoreceptor" (Fuji-Xerox). The three-component undercoat layer described therein requires moisture during curing.

For most dispersed undercoat layer formulations, such as, for example, that described in U.S. Pat. No. 5,612,157 to Yuh and Chambers entitled "Charge Blocking Layer for Electrophotographic Imaging Member," the range of suitable materials is somewhat limited. Many polymeric materials have the particle size, density, and dispersion stability in the proper range, but they have refractive index values that are too close to the binder resin used in the charge blocking layer. Light scattering particles having a refractive index similar to the binder refractive index may produce light scattering insufficient to eliminate the plywood effect in the resulting prints. Selecting inorganic particles such as metal oxides, which typically have a higher refractive index than polymeric materials, to be the light scattering particles is problematic because inorganic particles such as metal oxides generally have higher densities than polymeric materials and thus can create a particle settling problem that adversely affects the uniformity of the blocking layer and the quality of the resulting prints. Also, since the electrical properties tend to deteriorate when the undercoat layer is provided at a thickness of greater than about 6 micrometers, there is a thickness limitation of about 6 micrometers.

"Plywood effect" is a problem inherent in layered photoreceptors and so termed because when the spatial exposure variation in an image formed on a photoreceptor appears in the output print it looks like a pattern of light and dark interference fringes resembling the grains on a sheet of plywood. The issue of plywood effect has been addressed in the prior art by increasing the thickness of, and hence the absorption of light by, the charge generating layer. For most systems, this leads to unacceptable tradeoffs. For example, for a layered organic photoreceptor, an increase in dark decay characteristics and electrical instability may occur. U.S. Pat. No. 4,618,552 to Tanaka, Sumino, and Toma entitled "Light Receiving Member for Electrophotography Having Roughened Intermediate Layer" describes a method for compensating for plywood effect by using a photoconductive imaging member in which the ground plane, or an opaque conductive layer formed above or below the ground plane, is formed with a rough surface morphology to diffusively reflect the light.

Another method for compensating for plywood effect is described in U.S. Pat. No. 5,052,328 to Andrews and Simpson entitled "Photosensitive Imaging Member with a Low-Reflection Ground Plane." U.S. Pat. No. 5,052,328 describes a ground plane of low reflection material so as to reduce the reflections therefrom. U.S. Pat. No. 5,089,908 to Jodoin, Loce, Lama, Rees, Ibrahim, and Appel entitled "Plywood Suppression in ROS Systems" describes a multiple diode laser array used in a raster output scanning (ROS) system modified to reduce the effects of undesirable spatial exposure variation at the surface of certain types of layered, semi-transparent photoreceptors. The spatial absorption variation is later manifested as a plywood pattern formed on output prints derived from the exposed photoreceptor. The laser array is modified to form a merged scanning beam at the photoreceptor surface of two or more diode outputs, each output operating at a different wavelength than the other. In one embodiment, a plurality of diodes, each at a different wavelength, are sequentially addressed, and an image of each diode is scanned across the photoreceptor which results in an exposure distribution that would be similar to that formed by an incoherent beam.

The disclosures of the foregoing are hereby incorporated by reference herein in their entireties.

There is still a need in the art for improved photoreceptors that overcome or alleviate the above-mentioned and other problems and for an improved method for preparing such photoreceptors.

SUMMARY OF THE INVENTION

The invention comprises an imaging member comprising:

an electroconductive support containing an electroconductive layer thereon;

thereover a first layer comprising a metal alkyloxide, an amino siloxane, and a color change material dispersed in a binder;

wherein the color change material is a material that reversibly changes color in the presence of a Lewis base and which color change is reversible upon exposure to light; and a charge generating layer and a charge transport layer.

A process for preparing an imaging member comprising:

providing an electroconductive support having an electroconductive layer thereon;

forming thereover a first layer comprising a metal alkyloxide, an amino siloxane, and a color change material dispersed in a binder;

wherein the color change material is a material that reversibly changes color in the presence of a Lewis base and which color change is reversible upon exposure to light; and forming thereover a charge generating layer and a charge transport layer.

Important features of the present invention in embodiments include a first layer (also referred to herein as "undercoat layer") that can be thick, has a pH and light sensitive color change characteristic, and uses an ammonium titanate complex formed from the combination in the undercoat layer of the metal alkyl oxide and the amino siloxane. The present thick undercoat layer for xerographic photoreceptors can be coated at a thickness of up to about 20 microns. This permits rough substrates to be coated and prevents penetration of carbon fibers through the active layers to the substrate. The undercoat layer also provides improved hole blocking. Another important feature is the employment of the color change material that reversibly changes color as a function of pH and which color change is reversible upon exposure to light. Exemplary color change materials suitable for use in the present invention, include, but are not limited to, for example, phenolphthalein, phenolsulfonephthalein, thymolphthalein, and the like. In operation, the color change material turns color (e.g., red for phenolphthalein, blue for thymolphthalein, orange for phenolsulfonephthalein) in the presence of a Lewis base. The color changed undercoat layer absorbs light exposure energy and prevents reflection from the substrate and thus prevents plywood defects.

Imaging members prepared with the present undercoat layer provide good and stable electrical properties superior to those of previously available photoreceptors such as those prepared with dispersed titanium dioxide in a phenolic resin undercoat layer. Advantages of the invention include allowing use of a thick undercoat layer that does not employ dispersed nanoparticles and therefore is insensitive to substrate defects and can be coated on a rough surface of the photoreceptor drum. The invention provides an inexpensive solution for maintaining good electrical properties, effects plywood suppression, provides a stable coating solution, improves hole blocking, cyclic stability, low residual voltage and dark decay. The undercoat layer also provides a solution to the problem of carbon fiber penetration, which is a big problem in currently available thin undercoat layers. The process for preparing the imaging member is advantageously simple. Additionally, the imaging member prepared with the undercoat layer has a lifetime of more than 1.5 million cycles.

These and other features and advantages of the invention will be more fully understood from the following description of certain specific embodiments of the invention taken together with the accompanying drawings.

DESCRIPTION OF THE PREFERRED EMBODIMENT

Figure 1:
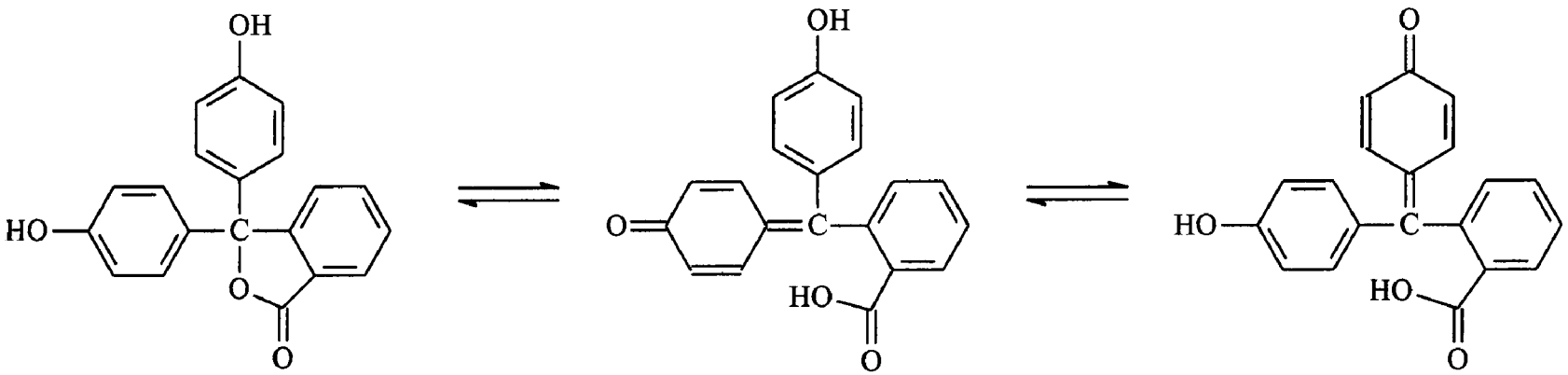
FIG. 1 illustrates exemplary structural formulae for phenolphthalein molecular conversions.

An imaging member comprises in embodiments an electroconductive support containing an electroconductive layer thereon; a first layer comprising an undercoat layer (the undercoat layer is also frequently termed a "blocking layer" or "charge blocking layer") disposed on the support, the undercoat layer comprising a metal alkyloxide, an amino siloxane, and a color change material dispersed in a binder; wherein the undercoat layer reversibly changes color in the presence of a Lewis base (generally defined as a species that can donate a pair of electrons and form a coordinate covalent bond) and further wherein the undercoat layer color change is reversible upon exposure to light, particularly light having a wavelength useful for xerography, such as, for example, light having a wavelength of about 4000 angstroms to about 9000 angstroms; and a charge generating layer and a charge transport layer.

Examples of metal alkyloxides suitable for use in the undercoat layer include, but are not limited to, metal methoxides, metal ethoxides, metal propoxides, metal isopropoxides, metal butoxides, titanium propoxide, titanium isopropoxide, titanium methoxide, titanium butoxide, titanium ethoxide, zirconium isopropoxide, zirconium propoxide, zirconium butoxide, zirconium ethoxide, zirconium methoxide, or combinations thereof.

The amino siloxane may comprise, for example, an amino siloxane such as an amino alkylalkoxysilane, including, but not limited to, 3-aminopropyltrimethoxysilane (APS), 3-aminopropyltriethoxysilane, 3-aminopropyldiisopropylethoxysilane, aminophenyltrimethoxysilane, 3-aminopropylmethyldiethoxysilane or 3-aminopropylpentamethyldisiloxane, and the like.

The color change component may comprise any suitable material that reversibly changes color in the presence of a Lewis base and which color change is reversible upon exposure to light. Exemplary color change materials suitable for use in the invention, include, but are not limited to, for example, phenolphthalein, phenolsulfonephthalein, thymolphthalein, and the like. The color change material is present in the undercoat layer in an amount such as from about 0.001% to about 50%, preferably from about 0.1% to about 10%, weight basis, based upon the total weight of the undercoat layer.

The undercoat layer is disposed in a polymer binder, such as polymethylmethacrylate (PMMA), polyvinyl butyral (PVB), polyvinyl alcohol, poly(hydroxyethyl methacrylate), poly(hydroxypropyl acrylate) or poly(vinylpyrrolidone); a copolymer, such as a vinyl halide, especially a vinyl chloride copolymer, such as poly(vinyl chloride-co-vinyl acetate), poly(vinyl chloride-co-vinyl acetate-co-vinyl alcohol), poly (vinylidene chloride-co-methyl acrylate) or poly(vinyl chloride-co-isobutyl vinyl ether) and the like. The solvent selected for the coating solution can be any suitable organic solvent, such as, for example, methyl ethyl ketone (MEK), tetrahydrofuran (THF), toluene, an alcohol, such as, for example, 1-propanol, 2-propanol, methanol, ethanol, 1-butanol; and acetone, among other solvents.

The metal alkyloxide, such as titanium isopropoxide, is present in the undercoat layer in an amount such as from about 5% to about 95%, preferably from about 20% to about 80% based upon the total weight of the undercoat layer.

The amino siloxane, such as 3-aminopropyltrimethoxysilane, is present in an amount of from about 95% to about 5%, preferably from about 80% to about 20% based upon the total weight of the undercoat layer.

The binder polymer, such as PVB, is present in an amount of from about 1% to about 99%, preferably from about 5% to about 70% based upon the total weight of the undercoat layer.

The solvent is provided in an amount suitable to control the viscosity of the coating solution, with total solution solvent concentrations typically being from about 5% to about 95%, preferably from about 15% to about 80% based upon the total weight of the undercoat layer.

Materials suitable for use as charge generating layers include, but are not limited to, photogenerating layer materials such as, for example, inorganic photoconductive materials such as amorphous selenium, trigonal selenium, and selenium alloys selected from the group consisting of selenium-tellurium, selenium-tellurium-arsenic, selenium arsenide and mixtures thereof, and organic photoconductive materials including various phthalocyanine pigments such as the X-form of metal free phthalocyanine, metal phthalocyanines such as vanadyl phthalocyanine and copper phthalocyanine, quinacridones, dibromo anthanthrone pigments, benzimidazole perylene, substituted 2,4-diamino-triazines, polynuclear aromatic quinones, and the like, dispersed in a film forming polymeric binder. Selenium, selenium alloy, enzimidazole perylene, and the like, and mixtures thereof, may be formed as a continuous, homogeneous photogenerating layer. Benzimidazole perylene compositions are well known and described, for example in U.S. Pat. No. 4,587,189 to Hor and Loutfy entitled "Photoconducting Imaging Members With Perylene Pigment Compositions," which is hereby incorporated by reference herein in its entirety. Multi-photogenerating layer compositions may be utilized where a photoconductive layer enhances or reduces the properties of the photogenerating layer. Other suitable photogenerating materials known in the art may also be utilized, if desired.

Any suitable charge generating binder layer comprising photoconductive particles dispersed in a film forming binder may be utilized. Photoconductive particles for the charge generating binder layer, such as vanadyl phthalocyanine, metal-free phthalocyanine, benzimidazole perylene, amorphous selenium, trigonal selenium, selenium alloys such as selenium-tellurium, selenium-tellurium-arsenic, selenium arsenide, and the like, and mixtures thereof, are especially preferred because of their sensitivity to white light. Vanadyl phthalocyanine, metal free phthalocyanine and tellurium alloys are also preferred because these materials provide the additional benefit of being sensitive to infrared light. The photogenerating materials selected should be sensitive to activating radiation having a wavelength between about 600 nanometers (nm) and about 700 nm during the imagewise radiation exposure step in an electrophotographic imaging process to form an electrostatic latent image.

Any suitable inactive resin material soluble in methylene chloride, chlorobenzene or other suitable solvent may be employed for the photogeneration layer binders including those described, for example, in U.S. Pat. No. 3,121,006, which is hereby incorporated by reference herein in its entirety. Typical organic resinous binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl butyral, polyvinyl acetate, polysiloxanes, polyacrylates, polyvinyl acetals, polyamides, polyimides, amino resins, phenylene oxide resins, terephthalic acid resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, and the like.

The photogenerating composition or pigment can be present in the resinous binder composition in various amounts. Generally, from about 5 percent to about 90 percent by volume of the photogenerating pigment is dispersed in about 10 percent to about 95 percent by volume of the resinous binder, and preferably from about 20 percent to about 30 percent by volume of the photogenerating pigment is dispersed in about 70 percent to about 80 percent by volume of the resinous binder composition.

The photogenerating layer containing photoconductive compositions and/or pigments and the resinous binder material generally are provided in a thickness of from about 0.1 micrometer to about 5 micrometers, and preferably have a thickness of from about 0.3 micrometer to about 3 micrometers. The thickness of the photogenerating layer is related to binder content, with higher binder content compositions generally requiring thicker layers for photogeneration. A thickness outside of these ranges can be selected providing the objectives of the present invention are achieved.

Materials suitable for use as charge transport layers include, but are not limited to, any suitable transparent organic polymer or non-polymeric material capable of supporting the injection of photogenerated holes and electrons from the trigonal selenium binder layer and allowing the transport of these holes or electrons through the organic layer to selectively discharge the surface charge. The active charge transport layer not only serves to transport holes or electrons, but also protects the photoconductive layer from abrasion or chemical attack and therefore extends the operating life of the photoreceptor imaging member. The charge transport layer should exhibit negligible, if any, discharge when exposed to a wavelength of light useful in xerography, e.g. 4000 angstroms to 9000 angstroms. Therefore, the charge transport layer is substantially transparent to radiation in a region in which the photoconductor is to be used. Thus, the active charge transport layer is a substantially non-photoconductive material which supports the injection of photogenerated holes from the generation layer.

The active transport layer is normally transparent when exposure is effected through the active layer to ensure that most of the incident radiation is utilized by the underlying charge carrier generator layer for efficient photogeneration. The charge transport layer in conjunction with the charge generation layer in the instant invention is a material which is an insulator to the extent that an electrostatic charge placed on the transport layer is not conducted in the absence of illumination.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

The charge transport layer forming mixture preferably comprises an aromatic amine compound. An especially preferred charge transport layer employed in one of the two electrically operative layers in the multi-layer imaging member of this invention comprises from about 35 percent to about 45 percent by weight of at least one charge transporting aromatic amine compound, and about 65 percent to about 55 percent by weight of a polymeric film forming resin in which the aromatic amine is soluble. The substituents should be free form electron withdrawing groups such as $NO_2$ groups, CN groups, and the like. Typical aromatic amine compounds include, for example, triphenylmethane, bis(4-diethylamine-2-methylphenyl)phenylmethane; 4'-4"-bis(diethylamino)-2',2"-dimethyltriphenylmethane, N,N'-bis (alkyl phenyl)-[1,1'-biphenyl]-4,4'-diamine wherein the alkyl is, for example, methyl, ethyl, propyl, n-butyl, etc., N,N'-diphenyl-N,N-bis(chlorophenyl)-[1,1'-biphenyl]-4,4'-diamine, N,N'-diphenyl-N,N'-bis(3"-methylphenyl)-(1,1'-biphenyl)-4,4'-diamine, and the like, dispersed in an inactive resin binder.

Examples of electrophotographic imaging members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures of which are hereby incorporated by reference herein in their entireties.

Figure 2:
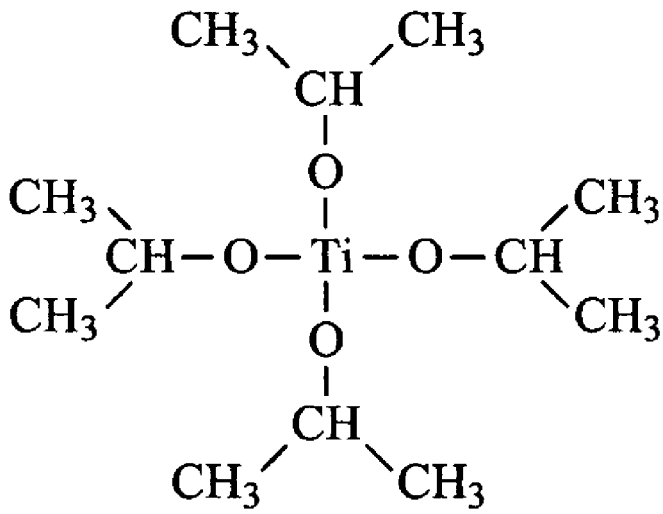
FIG. 2 illustrates a structural formula for a titanium isopropoxide molecule.
Figure 3:
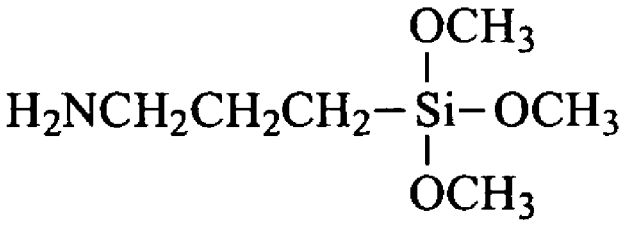
FIG. 3 illustrates a structural formula for a 3-aminopropyltrimethoxysilane molecule.

An embodiment of the present invention employing an undercoat layer comprising titanium isopropoxide as the metal alkyloxide, 3-aminopropylsilane as the amino siloxane, and phenolphthalein as the color change material, will now be described with reference to FIGS. 1–3 showing structural formulae for phenolphthalein molecular conversions (FIG. 1), a titanium isopropoxide molecule (FIG. 2), and an aminopropyltrimethoxysilane molecule (FIG. 3). The undercoat layer is provided in a solvent, preferably 2-propanol.

In the present undercoat layers, the metal alkyloxide and the amino siloxane form an ammonium titanate complex. Ammonium titanate is a very stable, conductive hybrid organic-inorganic complex with good solubility in alcohol. Although titanium isopropoxide and 3-aminopropylsilane are both very moisture sensitive compounds, titanium isopropoxide and 3-aminopropylsilane react to form an ammonium titanate complex at room temperature.

Phenolphthalein is colorless at a pH of less than about 8.0, but becomes red in a basic environment (i.e., an environment having a pH of more than about 8.0). This is because of the formation of a number of resonance hybrids, which are pink-red in color. Some of the molecular structure conversions of phenolphthalein are depicted in FIG. 1 wherein the phenolphthalein is first shown as colorless (such as phenolphthalein in an environment having a pH of less than 8) and is next shown as two resonance hybrids that are reversibly color changed from colorless to pink-red resonance hybrids (that is, showing formation of phenolphthalein resonance hybrids in a basic environment). The color change is reversible under light exposure encountered in xerographic applications, consuming the light passed through the charge generating layer and preventing the light reflection on the substrate surface which causes plywood effect. The amino group in the amino siloxane, such as 3-aminopropylsilane, is sufficiently basic to promote phenolphthalein color change in the inventive undercoat layer. The undercoat layer solution as prepared appears slightly yellow.

The undercoat layer solution can be coated at a thickness of up to about 20 micrometers on a photoreceptor support such as an aluminum drum substrate, through, for example, Tsukiage-dip coating. If desired, the undercoat layer can be thin, such as about 0.1 micron to a thickness, as stated above, or thick, such as up to about 20 microns. The undercoat layer may also be applied by any suitable technique such as spraying, dip coating, draw bar coating, gravure coating, silk screening, air knife coating, reverse roll coating, vacuum deposition, chemical treatment and the like.

Additional substrates suitable for use include, for example, metals and metal alloys including aluminum, zirconium, niobium, tantalum, vanadium, hafnium, titanium, nickel, stainless steel, chromium, tungsten, molybdenum, and the like. Where the entire substrate is an electrically conductive metal, the outer surface thereof can perform the function of an electrically conductive layer and a separate electrical conductive layer may be omitted.

The present invention will be further explained with reference to the following examples and control, it being noted that these examples are intended to illustrate and not limit the scope of the present invention.

EXAMPLE 1

4.0 grams of titanium isopropoxide 98+% (Fisher Scientific) were added directly into a brown bottle containing 4.0 grams of 3-aminopropyltrimethoxysilane 97% (Fisher Scientific) with slight stirring. The exothermic reaction occurred instantly to give a clear solution. The reaction was stoichiometric, generating an ammonium titanate complex. This solution was allowed to cool naturally until it reached room ambient temperature (i.e., about 24° C.). The cooled solution was added into a polymer solution containing 1.5 grams of polyvinyl butyral (Sekisui Specialty Chemicals Company) and 0.1 grams of phenolphthalein (Aldrich Chemical) in 20 grams of a 1-propanol solvent. The mixture was stirred slightly on a roll mill (U.S. Stoneware, Akron, Ohio) for about 15 hours to obtain a clear solution therefore indicating that the solution was ready to be coated as an undercoat layer. The solution appeared very stable with no obvious visual viscosity change after the solution stood at room temperature for about one month.

EXAMPLE 2

The prepared undercoat layer solution of Example 1 was coated onto a 30 millimeter in diameter aluminous drum substrate to a thickness of about 8.8 microns by Tsukiage dip coating method at 350 millimeters/minute pull-rate. The coated undercoat layer was dried in a forced air oven at about 135° C. for about 45 minutes. After drying, a charge generating layer and a charge transport layer were coated sequentially onto the undercoat layer by dip coating. The charge generating layer solution comprised 2.5 weight percent of hydroxy-gallium phthalocyanine (Xerox Corporation) and 2.5 weight percent of poly(vinyl chloride) copolymer with molecular weight Mw=40,000 (VMCH from Dow Chemicals) in 95 weight percent of n-butyl acetate and was coated at a thickness of about 0.3 microns. The charge transport layer solution comprised 8.0 weight percent of N,N'-diphenyl-N,N'-bis(3-methylphenyl)-1,1'-biphenyl-4,4'-diamine, 12.0 weight percent of poly(4,4'-diphenyl-1,1'-cyclohexane carbonate (Mitsubishi Chemicals) in 80 weight percent of tetrahydrofuran and was coated at a thickness of about 25 microns.

COMPARATIVE EXAMPLE 3

A comparative example (Control) comprising a titanium oxide/phenolic resin dispersion was prepared by ball milling 15 grams of titanium dioxide (STR60N™, Sakai Company), 20 grams of the phenolic resin VARCUM™ 29159 (OxyChem Company, Mw about 3,600, viscosity about 200 cps) in 7.5 grams of 1-butanol and 7.5 grams of xylene with 120 grams of 1 millimeter diameter sized $ZrO_2$ beads for 5 days. Separately, a slurry of $SiO_2$ and a phenolic resin was prepared by adding 10 grams of $SiO_2$ (P100, Esprit) and 3 grams of the above phenolic resin into 19.5 grams of 1-butanol and 19.5 grams of xylene. The resulting titanium dioxide dispersion was filtered with a 20 micrometer pore size nylon cloth, the filtrate was measured with a Horiba Capa 700 Particle Size Analyzer and there was obtained a median $TiO_2$ particle size of 50 nanometers in diameter and a $TiO_2$ particle surface area of 30 $m^2$/gram with reference to the above $TiO_2$/VARCUM dispersion. Additional solvents comprising 5 grams of 1-butanol and 5 grams of xylene; 2.6 grams of bisphenol S (4,4'-sulfonyldiphenol) and 5.4 grams of the above prepared $SiO_3$/VARCUM slurry were added to 50 grams of the above resulting titanium dioxide/VARCUM dispersion, referred to as the coating dispersion. The aluminum drum was cleaned with detergent, rinsed with deionized water, and dip coated with the coating dispersion at a pull rate of 160 millimeters/minute, and subsequently dried at 160° C. for 15 minutes, which resulted in an undercoat layer with a thickness of 3.5 microns. The charge generating layer and charge transport layer were prepared by the same method as described in Example 2 above.

EXAMPLE 4

The electrical properties of the prepared photoreceptor device with the present undercoat layer (Example 1) and the Control were tested in accordance with standard drum photoreceptor test methods. The electrical properties of the photoreceptor samples prepared according to Example 2 and Comparative Example 3 were evaluated with a xerographic testing scanner. The drums were rotated at a constant surface speed of 15.7 cm per second. A direct current wire scorotron, narrow wavelength band exposure light, erase light, and four electrometer probes were mounted around the periphery of the mounted photoreceptor samples. The sample charging time was 177 milliseconds. The exposure light had an output wavelength of 680 nanometers (nm) and the erase light had an output wavelength of 550 nm.

The test samples were first rested in the dark for at least 60 minutes to ensure achievement of equilibrium with the testing conditions at 50 percent relative humidity and 72° F. Each sample was then negatively charged in the dark to a potential of about 500 volts. The test procedure was repeated to determine the photo induced discharge characteristic (PIDC) of each sample by different light energies of up to 40 ergs/$cm^2$.

Figure 4:
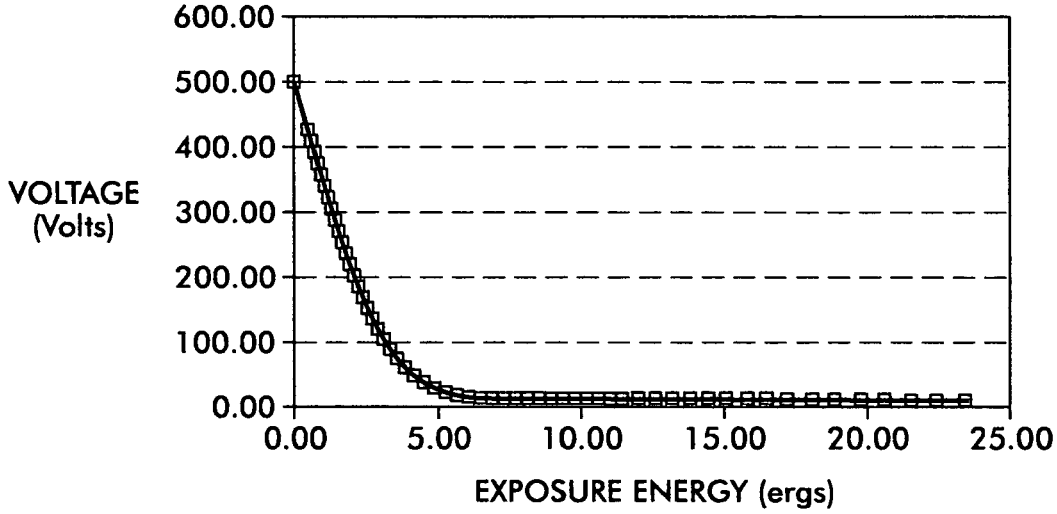
FIG. 4 is a graph showing photo-induced discharge characteristics of a photoreceptor prepared in accordance with an embodiment of the present invention.

FIG. 4 provides a graph showing PIDC characteristics of a photoreceptor prepared in accordance with an embodiment of the present invention as described in the above example. The PIDC in FIG. 4 illustrate a very good photo-induced discharge performance. Other electrical properties are shown in Table 1.

The results achieved with the example prepared in accordance with the invention are superior to that of the Control as shown in the comparison in Table 1. The example in accordance with the invention exhibited excellent charging characteristics with low residual potential and low dark decay.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. An imaging member comprising:

an electroconductive support containing an electroconductive layer thereon;

thereover a first layer comprising a metal alkyloxide, an amino siloxane, and a color change material dispersed in a binder;

wherein the color change material is a material that reversibly changes color in the presence of a Lewis base and which color change is reversible upon exposure to light; and thereover a charge generating layer and a charge transport layer.

2. The imaging member of claim 1, wherein the metal alkyloxide is selected from the group consisting of metal methoxides, metal ethoxides, metal propoxides, metal isopropoxides, metal butoxides, titanium propoxide, titanium isopropoxide, titanium methoxide, titanium butoxide, titanium ethoxide, zirconium isopropoxide, zirconium propoxide, zirconium butoxide, zirconium ethoxide, zirconium methoxide, or a combination thereof.

3. The imaging member of claim 1, wherein the siloxane is selected from the group consisting of amino alkylalkoxysilanes, 3-aminopropyltrimethoxysilane, 3-aminopropyltriethoxysilane, 3-aminopropyldiisopropylethoxysilane, aminophenyltrimethoxysilane, 3-aminopropylmethyldiethoxysilane, 3-aminopropylpentamethyldisiloxane, or a combination thereof.

TABLE 1

| | V(0) (volt) | V(2.6) (volt) | V(4.26) (volt) | V(13) (volt) | Dv/dx (volt * $cm^2$/erg.) | Verase (volt) | Dark decay (volt) | Q/A PIDC (nC/cm^2) |
|---|---|---|---|---|---|---|---|---|
| Example 2 | 500 | 160 | 42 | 8 | −164 | 5 | 9 | 65 |
| Comparative Example 3 | 496 | 166 | 100 | 59 | −184 | 46 | 13 | 56 |

With reference to the abbreviations employed in Table 1:

V(0) (PIDC) is the dark voltage after scorotron charging

Q/A PIDC is the current density to charge the devices to the V(0) values

Dark Decay is 0.2s Duration Decay voltage

V(2.6) is average voltage after exposure to 2.6 erg/$cm^2$

V(4.26) is average voltage after exposure to 4.26 erg/$cm^2$

V(13) is average voltage after exposure to 13 erg/$cm^2$ dV/dX is the initial slope of the PIDC Verase is average voltage after erase exposure

4. The imaging member of claim 1, wherein the color change material is selected from the group consisting of phenolphthalein, phenolsulfonephthalein, thymolphthalein, or a combination thereof.

5. The imaging member of claim 1, wherein the first layer is disposed at a thickness of about 0.1 microns to about 20 microns.

6. The imaging member of claim 1, wherein the support comprises a metal, metal alloy, aluminum, zirconium, niobium, tantalum, vanadium, hafnium, titanium, nickel, stainless steel, chromium, tungsten, molybdenum, or a combination thereof.

7. The imaging member of claim 1, wherein the charge generating layer comprises a material selected from the group consisting of inorganic photoconductive materials, amorphous selenium, trigonal selenium, selenium alloys, selenium-tellurium, selenium-tellurium-arsenic, selenium arsenide, organic photoconductive materials, phthalocyanine pigments, the X-form of metal free phthalocyanine, metal phthalocyanines, vanadyl phthalocyanine, copper phthalocyanine, quinacridones, dibromo anthanthrone pigments, benzimidazole perylene, substituted 2,4-diamino-triazines, polynuclear aromatic quinones, enzimidazole perylene, or a combination thereof.

8. The imaging member of claim 1, wherein the charge transport layer comprises a material selected from the group consisting of a charge transporting aromatic amine compound, triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine, N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, or a combination thereof.

9. The imaging member of claim 1, wherein the metal alkyloxide is present in the first layer in an amount of from about 5% to about 95%, based upon the total weight of the first layer.

10. The imaging member of claim 1, wherein the amino siloxane is present in the first layer in an amount of from about 5% to about 95%, based upon the total weight of the first layer.

11. The imaging member of claim 1, wherein the color change material is present in the first layer in an amount such as from about 0.001% to about 50%, weight basis, based upon the total weight of the first layer.

12. A process for preparing an imaging member comprising:

providing an electroconductive support having an electroconductive layer thereon;

forming thereover a first layer comprising a metal alkyloxide, an amino siloxane, and a color change material dispersed in a binder;

wherein the color change material is a material that reversibly changes color in the presence of a Lewis base and which color change is reversible upon exposure to light; and forming thereover a charge generating layer and a charge transport layer.

13. The process of claim 12, wherein the metal alkyloxide is selected from the group consisting of metal methoxides, metal ethoxides, metal propoxides, metal isopropoxides, metal butoxides, titanium propoxide, titanium isopropoxide, titanium methoxide, titanium butoxide, titanium ethoxide, zirconium isopropoxide, zirconium propoxide, zirconium butoxide, zirconium ethoxide, zirconium methoxide, or a combination thereof.

14. The process of claim 12, wherein the amino siloxane is selected from the group consisting of an amino alkylalkoxysilane, 3-aminopropyltrimethoxysilane, 3-aminopropyltriethoxysilane, 3-aminopropyldiisopropylethoxysilane, aminophenyltrimethoxysilane, 3-aminopropylmethyldiethoxysilane, 3-aminopropylpentamethyldisiloxane, or a combination thereof.

15. The process of claim 12, wherein the color change material is selected from the group consisting of phenolphthalein, phenolsulfonephthalein, thymolphthalein, or a combination thereof.

16. The process of claim 12, wherein the support comprises a metal, metal alloy, aluminum, zirconium, niobium, tantalum, vanadium, hafnium, titanium, nickel, stainless steel, chromium, tungsten, molybdenum, or a combination thereof.

17. The process of claim 12, wherein the charge generating layer comprises a material selected from the group consisting of inorganic photoconductive materials, amorphous selenium, trigonal selenium, selenium alloys, selenium-tellurium, selenium-tellurium-arsenic, selenium arsenide, organic photoconductive materials, phthalocyanine pigments, the X-form of metal free phthalocyanine, metal phthalocyanines, vanadyl phthalocyanine, copper phthalocyanine, quinacridones, dibromo anthanthrone pigments, benzimidazole perylene, substituted 2,4-diamino-triazines, polynuclear aromatic quinones, enzimidazole perylene, or a combination thereof.

18. The process of claim 12, wherein the charge transport layer comprises a material selected from the group consisting of a charge transporting aromatic amine compound, triphenylmethane, bis(4-diethylamine-2-methylphenyl)phenylmethane; 4'-4"-bis(diethylamino)-2',2"-dimethyltriphenylmethane, N,N'-bis(alkylphenyl)-[1,1'-biphenyl]-4,4'-diamine, N,N'-diphenyl-N,N'-bis(chlorophenyl)-[1,1'-biphenyl]-4,4'-diamine, N,N'-diphenyl-N,N'-bis(3"-methylphenyl)-(1,1'-biphenyl)-4,4'-diamine, or a combination thereof.

19. The process of claim 12, wherein forming a first layer comprises forming the first layer at a thickness of about 0.1 micron to about 20 microns.

20. The process of claim 12, wherein the metal alkyloxide is present in the first layer in an amount of from about 5% to about 95%, based upon the total weight of the first layer.

21. The process of claim 12, wherein the amino siloxane is present in the first layer in an amount of from about 95% to about 5%, based upon the total weight of the first layer.

22. The process of claim 12, wherein the color change material is present in the first layer in an amount such as from about 0.001% to about 50%, weight basis, based upon the total weight of the first layer.

23. The imaging member of claim 1, wherein the metal alkyloxide is present in the first layer in an amount of from about 20% to about 80%, based upon the total weight of the first layer.

24. The imaging member of claim 1, wherein the amino siloxane is present in the first layer in an amount of from about 80% to about 20% based upon the total weight of the first layer.

25. The imaging member of claim 1, wherein the color change material is present in the first layer in an amount such as from about 0.1% to about 10%, weight basis, based upon the total weight of the first layer.

26. The process of claim 12, wherein the metal alkyloxide is present in the first layer in an amount of from about 20% to about 80%, based upon the total weight of the first layer.

27. The process of claim 12, wherein the amino siloxane is present in the first layer in an amount of from about 80% to about 20%, based upon the total weight of the first layer.

28. The process of claim 12, wherein the color change material is present in the first layer in an amount such as from about 0.1% to about 10%, weight basis, based upon the total weight of the first layer.

* * * * *